US008538663B2

(12) United States Patent
Jung et al.

(10) Patent No.: US 8,538,663 B2
(45) Date of Patent: Sep. 17, 2013

(54) METHOD FOR ADAPTING THE PERFORMANCE OF A FUEL PREFEED PUMP OF A MOTOR VEHICLE

(75) Inventors: Uwe Jung, Wörth a. d. Donau (DE); Janos Radeczky, Wenzenbach (DE); Michael Wirkowski, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 249 days.

(21) Appl. No.: 12/999,956

(22) PCT Filed: Jun. 17, 2009

(86) PCT No.: PCT/EP2009/057498
§ 371 (c)(1), (2), (4) Date: Jan. 5, 2011

(87) PCT Pub. No.: WO2010/012542
PCT Pub. Date: Feb. 4, 2010

(65) Prior Publication Data
US 2011/0118958 A1 May 19, 2011

(30) Foreign Application Priority Data
Aug. 1, 2008 (DE) ..... 10 2008 036 122

(51) Int. Cl.
*F02D 41/38* (2006.01)

(52) U.S. Cl.
USPC ..... 701/103; 123/456; 123/458

(58) Field of Classification Search
USPC ..... 701/102–106, 112–114; 123/179.17, 123/446, 447, 456, 458, 486, 495, 497
See application file for complete search history.

(56) References Cited

U.S. PATENT DOCUMENTS

| | | | | |
|---|---|---|---|---|
| 5,394,844 | A * | 3/1995 | Akimoto | 123/179.3 |
| 6,167,903 | B1 * | 1/2001 | Newman | 137/351 |
| 7,021,261 | B2 | 4/2006 | Joos et al. | 123/179.17 |
| 7,325,537 | B2 | 2/2008 | Mueller et al. | 123/506 |
| 7,438,051 | B2 | 10/2008 | Wachtendorf et al. | 123/446 |
| 7,637,252 | B2 | 12/2009 | Jung et al. | 123/447 |
| 7,706,962 | B2 * | 4/2010 | Fushiki et al. | 701/114 |

(Continued)

FOREIGN PATENT DOCUMENTS

| | | |
|---|---|---|
| CN | 101087938 A | 12/2007 |
| DE | 10151513 A1 | 5/2003 |

(Continued)

OTHER PUBLICATIONS

German Office Action, German Patent Application No. 10 2008 036 122.4-13, 2 pages, Feb. 4, 2009.

(Continued)

*Primary Examiner* — John Kwon
*Assistant Examiner* — Johnny Hoang
(74) *Attorney, Agent, or Firm* — King & Spalding L.L.P.

(57) ABSTRACT

In a method for adapting the performance of a fuel prefeed pump of a motor vehicle which has a common rail injection system and an internal combustion engine, after the ignition is switched on and before the internal combustion engine is started, adaptation values are determined and stored which are assigned to the fuel prefeed pump and describe its individual performance. After the internal combustion engine is started, the stored adaptation values are taken into consideration during the determining of an actuating signal for the prefeed pump.

18 Claims, 3 Drawing Sheets

(56) References Cited

U.S. PATENT DOCUMENTS

| | | | | |
|---|---|---|---|---|
| 2003/0217721 | A1* | 11/2003 | Adams et al. | 123/179.16 |
| 2004/0000289 | A1 | 1/2004 | Seo et al. | 123/447 |
| 2005/0211224 | A1 | 9/2005 | Inaguma et al. | 123/458 |
| 2005/0274362 | A1* | 12/2005 | DeRaad | 123/497 |
| 2006/0162324 | A1* | 7/2006 | Pott et al. | 60/299 |
| 2006/0266331 | A1* | 11/2006 | Nagano et al. | 123/406.47 |
| 2007/0079808 | A1* | 4/2007 | Takahashi | 123/447 |
| 2007/0175454 | A1* | 8/2007 | Shimazaki et al. | 123/497 |
| 2007/0199542 | A1* | 8/2007 | Tokuda et al. | 123/431 |
| 2007/0283935 | A1* | 12/2007 | Yuda et al. | 123/497 |
| 2007/0289577 | A1* | 12/2007 | Yamaguchi et al. | 123/446 |
| 2007/0295310 | A1 | 12/2007 | Achleitner et al. | 123/495 |
| 2009/0107442 | A1* | 4/2009 | Ma et al. | 123/179.17 |
| 2009/0120397 | A1* | 5/2009 | Prior | 123/179.17 |
| 2009/0138175 | A1* | 5/2009 | Lenz et al. | 701/103 |
| 2009/0217910 | A1* | 9/2009 | Alessandri et al. | 123/446 |
| 2009/0240417 | A1* | 9/2009 | Fushiki et al. | 701/103 |
| 2010/0063708 | A1* | 3/2010 | Dotzer et al. | 701/102 |
| 2010/0174469 | A1* | 7/2010 | Vannucci Oliveira et al. | 701/103 |
| 2011/0118958 | A1 | 5/2011 | Jung et al. | 701/103 |

FOREIGN PATENT DOCUMENTS

| | | | |
|---|---|---|---|
| DE | 10162989 | | 10/2003 |
| DE | 10360332 | | 7/2005 |
| DE | 102004062613 | | 7/2006 |
| DE | 102005043684 | | 3/2007 |
| DE | 102006004296 | A1 | 8/2007 |
| DE | 102006023470 | A1 | 11/2007 |
| DE | 102006026928 | A1 | 12/2007 |
| EP | 1249599 | | 10/2002 |
| EP | 1541838 | | 6/2005 |
| FR | 2878291 | | 5/2006 |
| WO | 2010/012542 | A1 | 2/2010 |

OTHER PUBLICATIONS

International Search Report and Written Opinion for Application No. PCT/EP2009/058605 (15 pages), Sep. 18, 2009.

International Search Report and Written Opinion for Application No. PCT/EP2009/057498 (13 pages), Sep. 23, 2009.

Chinese Office Action, Application No. 200980124370.3, 17 pages, Sep. 5, 2012.

* cited by examiner

METHOD FOR ADAPTING THE PERFORMANCE OF A FUEL PREFEED PUMP OF A MOTOR VEHICLE

CROSS-REFERENCE TO RELATED APPLICATIONS

This application is a U.S. National Stage Application of International Application No. PCT/EP2009/057498 filed Jun. 17, 2009, which designates the United States of America, and claims priority to German Application No. 10 2008 036 122.4 filed Aug. 1, 2008, the contents of which are hereby incorporated by reference in their entirety.

TECHNICAL FIELD

The invention relates to a method for adapting the performance of a fuel prefeed pump of a motor vehicle which has a common rail injection system and an internal combustion engine.

BACKGROUND

Common rail injection systems are already known. These are injection systems for internal combustion engines in which a high-pressure pump brings the fuel to a high pressure level. The pressurized fuel fills a pipeline system which is constantly pressurized during operation of the engine.

A common rail injection system of this kind is known from DE 10 2006 023 470 A1. The system described there has a high-pressure fuel pump for conveying fuel, a high-pressure fuel tank, connected to the high-pressure fuel pump, for storing fuel at injection pressure with respect to the environment of the common rail injection system, an injector, connected to the high-pressure fuel tank, for releasing the fuel into at least one combustion chamber, a return line for returning fuel from the injector to the high-pressure fuel pump at a return pressure with respect to the environment of the common rail injection system, and adjusting means for adjusting the return pressure. During operation the high-pressure fuel pump sucks in fuel from a fuel tank and compresses it to an injection pressure.

A further common rail injection system is known from DE 10 2006 026 928 A1. The system described there includes a fuel tank, a high-pressure fuel pump, a rail pipe, a pressure accumulator, an injector and a digital controller. A volume flow rate control valve, which is actuated by the digital controller via a volume flow rate control valve actuating line, is arranged in the feed line between the fuel tank and the high-pressure fuel pump. The high-pressure fuel pump comprises at least one compressor, for example a pump cylinder or plunger. During operation of the injection system it supplies a time-dependent injection pressure that is applied in the rail pipe to the injector.

In common rail injection systems the fuel is frequently supplied to the high-pressure fuel pump using a prefeed pump. This prefeed pump is usually arranged in the fuel tank and/or the supply pipe. It can be an electrically actuatable prefeed pump or a fixed delivery pump. By means of a prefeed pump of this kind the fuel is brought to a pressure value which is kept constant as a function of the volume of fuel removed by the high-pressure fuel pump using a pressure-limiting valve arranged between the fuel tank and the high-pressure fuel pump.

In practice prefeed pumps comprise manufacturing-related series variations. Furthermore, variations in on-board voltage supply occur in practice in the on-board supply system of the respective vehicle. The consequence of this is that different prefeed volumes are established in the case of electrically actuated prefeed pumps. This has the drawback that the fill level of the high-pressure fuel pump varies, and this can lead to problems in controlling the rail pressure. Furthermore, a volume of fuel that equalizes the range of variation must be stored in the case of electrically actuated fuel pumps, i.e. more fuel than is required has to be conveyed unnecessarily in order to avoid potential deficiencies in supply.

Increased control input is required in order to avoid different fill levels of the high-pressure fuel pump. Storing a volume of fuel that equalizes the range of variation is associated with the drawback of an increased power requirement and a possible over-dimensioning of the pump. Fuel consumption and the carbon dioxide emissions of the respective motor vehicle are also increased as a result.

SUMMARY

According to various embodiments, the drawbacks described above can be avoided.

According to an embodiment, in method for adapting the performance of a fuel prefeed pump of a motor vehicle which has a common rail injection system and an internal combustion engine, —after the ignition is switched on and before the internal combustion engine is started, adaptation values are determined and stored which are assigned to the fuel prefeed pump and describe its individual performance, and—after the internal combustion engine is started, the stored adaptation values are taken into consideration during the determining of an actuating signal for the prefeed pump.

According to a further embodiment, fuel can be pumped from a fuel tank into the rail of the common rail injection system by means of the fuel prefeed pump, and the fuel pressure prevailing in the rail is measured by means of a pressure sensor. According to a further embodiment, the performance of the fuel prefeed pump can be gradually linearly increased up to maximum performance of the fuel prefeed pump and pairs of parameters are formed, one of these parameters being a performance value and the other parameter being the actual pressure value assigned to this performance value. According to a further embodiment, the parameter pairs can be stored. According to a further embodiment, the parameter pairs can be used to create a pressure characteristic curve individually assigned to the prefeed pump. According to a further embodiment, transitions at which changes in gradient occur can be detected in the pressure characteristic curve individually assigned to the prefeed pump. According to a further embodiment, the adaptation parameters can be determined from the pressure and performance values associated with the transitions. According to a further embodiment, the pressure and performance values associated with the transitions can be stored in a memory as non-volatile information, and during the life of the common rail injection system the transitions in the pressure characteristic curve can be repeatedly determined and associated pressure and performance values are stored in a memory as non-volatile information, and the loading condition of a fuel filter arranged in the motor vehicle is determined by using the stored pressure and performance values.

BRIEF DESCRIPTION OF THE DRAWINGS

Further advantageous properties can be found in their description below with reference to the figures, in which.

DETAILED DESCRIPTION

The advantages of various embodiments lie in particular in that the influence of series variance in prefeed pumps on rail pressure regulation is reduced. Furthermore, compared with the prior art, the volume of fuel that is to be stored is reduced, the energy requirement of the prefeed pump is minimized, the fuel consumption of the vehicle is reduced and the carbon dioxide emissions of the vehicle are reduced.

Loading of the fuel filter is advantageously also detected, so the replacement interval for the fuel filter no longer has to be made dependent on the kilometer reading of the vehicle, but can be made dependent on the actual condition of the fuel filter. In many cases this leads to the interval for fuel filter replacement being extended compared with the prior art.

Figure 1:
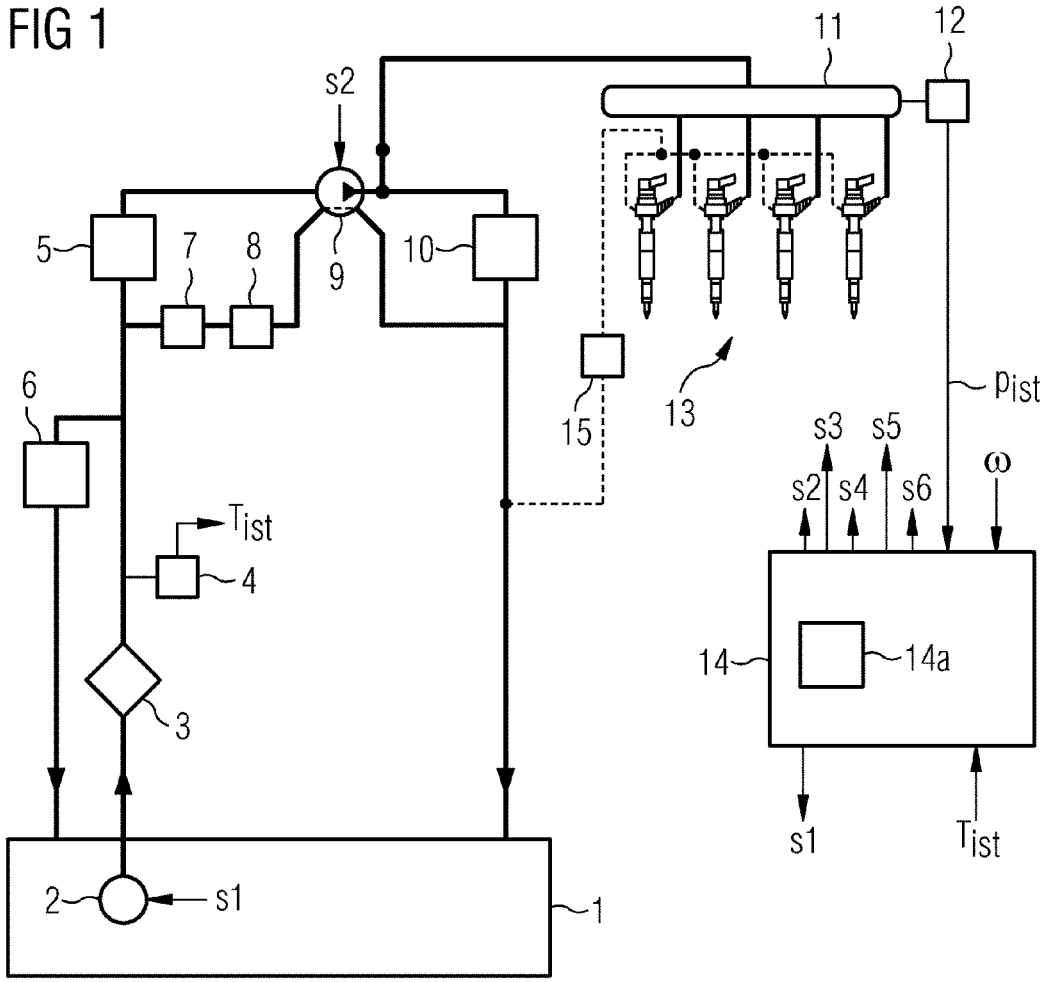
FIG. 1 shows a block diagram to describe an exemplary embodiment.

FIG. 1 shows a block diagram to describe an exemplary embodiment.

The illustrated device comprises a fuel tank 1, from which fuel is supplied via a fuel filter 3 and a volume flow rate control valve 5 to a high-pressure fuel pump 9 using a prefeed pump 2. The prefeed pump 2 can be electrically actuated and is acted upon by an activation signal s1 which is provided by a controller 14.

The fuel is compressed to a desired high pressure level in the high-pressure fuel pump 9.

The fuel dispensed from the high-pressure fuel pump 9 is passed on into a pressure accumulator or a rail 11 and from there is injected by means of injectors 13 actuated by the controller 14 into respectively associated combustion chambers of a motor vehicle, these combustion chambers being associated with the internal combustion engine of the motor vehicle. The activation signals for the injectors 13, provided by the controller 14, are designated by reference characters s3, s4, s5 and s6. The actual pressure of the fuel in the rail is measured during operation by means of a high-pressure sensor 12 connected to the rail 11 and is communicated to the controller 14 in the form of an actual pressure value signal $p_{ist}$.

A temperature sensor 4 contacted by the fuel pipe is provided between the fuel filter 3 and the volume flow rate control valve 5. The temperature sensor 4 detects the temperature of the fuel and communicates it to the controller 14 in the form of an actual temperature value signal $T_{ist}$.

A pressure-limiting valve 6 is also provided which returns fuel into the fuel tank 1 when the pressure of the fuel in the fuel pipe between the fuel filter 3 and the volume flow rate control valve 5 exceeds a predefined limiting value, which depends on the volume of fuel removed by the high-pressure fuel pump 9 and the characteristic curve of the pressure-limiting valve 5.

A flushing valve 7 and a flushing throttle 8 are also provided via which fuel is passed to the high-pressure fuel pump 9 and is returned via them into the fuel tank 1. The purpose of the flushing valve 7 and the flushing throttle 8 consists in ensuring that the mechanical drive of the pump is provided with fuel for lubrication.

A pressure-regulating valve 10 is also connected to the high-pressure fuel pump 9 and limits the pressure of the highly pressurized fuel leaving the high-pressure fuel pump 9 to a predefined maximum value. If this value is exceeded the pressure-regulating valve 10 then opens and returns fuel into the fuel tank 1.

The injectors 13 are also connected by a check valve 15 to the fuel tank 1, so excess fuel from the injectors 13 can be returned to the fuel tank 1 via the check valve 15.

The fuel pressure generated by means of the prefeed pump 2 is determined using the high pressure sensor 12 to reduce the influence of series variations in the prefeed pump 2 and/or variations in on-board voltage supplies on the injection system. The volume flow rate control valve is opened in the process in the case of a prefeed pump 2 that is already conveying fuel. The result of this is that the fuel conveyed out of the fuel tank 1 fills the opened cylinders of the high-pressure fuel pump 9 and due to its prefeed pressure the outlet valves of the high-pressure fuel pump 9 are opened. The pressure produced in the rail 11 is consequently brought to a value that matches the prefeed pressure. This prefeed pressure is measured by means of the high-pressure sensor 12 and communicated to the controller 14. The controller 14 evaluates the prefeed pressure characteristic curve, determines the performance of the prefeed pump at hand therefrom and stores adaptation values in a memory 14*a*. These adaptation values are used during normal operation of the injection system to bring the prefeed pressure generated by the prefeed pump 2 to a desired value. This takes place by way of activation of the prefeed pump 2 by the controller 14 using an activation signal s1 which takes into consideration said adaptation values.

Consequently series variations in prefeed pumps, inlet valves and pressure-limiting valves are equalized and the influence of these variations on injection regulation is minimized. The result of this is that the volume of stored fuel may also be reduced to the required minimum, the energy requirement of the prefeed pump is reduced, the fuel consumption of the motor vehicle is reduced and the carbon dioxide emissions of the motor vehicle are lowered.

A further advantage consists in that—as will be described—the fuel filter loading can be detected, so if a blocked fuel filter is detected a "change fuel filter" status flag can be set. The interval for changing a fuel filter consequently no longer has to be made to depend on the kilometer reading of the respective vehicle, but can advantageously be adapted to the filter loading that actually exists. In many vehicles this significantly extends the replacement interval.

Figure 2:
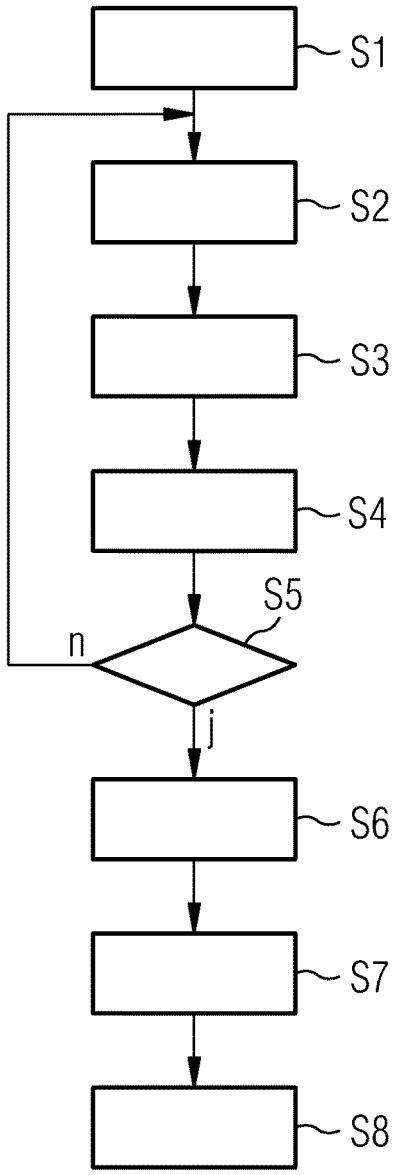
FIG. 2 shows a flow diagram to describe a method according to an embodiment.

FIG. 2 shows a flow diagram to describe a method for adapting the performance of a fuel prefeed pump of a motor vehicle. In this method it is assumed that the internal combustion engine of the motor vehicle, and therewith the high-pressure fuel pump that is mechanically driven by the internal combustion engine, are idle, as is the case, for example, just before an engine is started.

The ignition is switched on in step S1. The electrical supply to the controller 14, the high-pressure sensor 12, the high-pressure control actuators of the high-pressure fuel pump 9 and the electrical activatable prefeed pump 2 are activated as a result of switching on the ignition.

After switching on the ignition but before starting the engine the performance of the prefeed pump 2 is determined in steps S2 to S6 using the controller 14.

The performance of the prefeed pump 2 is gradually linearly increased within a predefined time T=0 to T=ti to the maximum performance of the prefeed pump 2 by way of activation by the controller 14 using an activation signal s1. The performance is in each case increased by a predefined performance increment in step S2, the pressure in the rail 11 is measured by means of the high-pressure sensor 12 and the measured pressure value is passed to the controller 14 in the form of the actual pressure value signal $p_{ist}$ in step S3, the respective parameter pair actual pressure value signal+performance value are stored in the memory 14*a* in step S4, and in step S5 it is queried whether the predefined time ti has already been reached. If this is not the case the method then jumps back to step S2 and the performance of the prefeed pump is increased by the predefined performance increment, the pressure in the rail is measured by means of the high-pressure sensor and the measured actual pressure value is passed to the controller and the parameter pair actual pressure value signal+performance value is stored in the memory 14*a*. It is then again queried in step S5 whether the time ti has already been reached or not. If this is not the case the method jumps back to step S2 again. If, on the other hand, time ti is reached and the performance of the prefeed pump 2 is therefore increased to its maximum value, the method jumps to step S6.

The stored parameter pairs are evaluated in step S6 to determine adaptation values individually assigned to the prefeed pump at hand. These adaptation values are also stored in the memory 14*a* of the controller 14. During subsequent operation of the engine the activation signals s1 for the prefeed pump 2 are provided by taking into consideration these adaptation values in such a way that series variances in the prefeed pump are equalized and fuel is supplied at the desired prefeed pressure to the high-pressure fuel pump 9 via the fuel filter 3 and the volume flow control valve 5.

Once evaluation of the stored parameter pairs is finished and determination and storing of the adaptation values in the memory 14*a* have taken place the engine is started in step S7. Finally, during normal operation of the engine, and therewith of the common rail injection system as well, the adaptation values stored in the memory 14*a* are used in step S8 to determine the activation signals s1 for the prefeed pump 2 in such a way that this fuel is delivered at the desired prefeed pressure.

Figure 3:
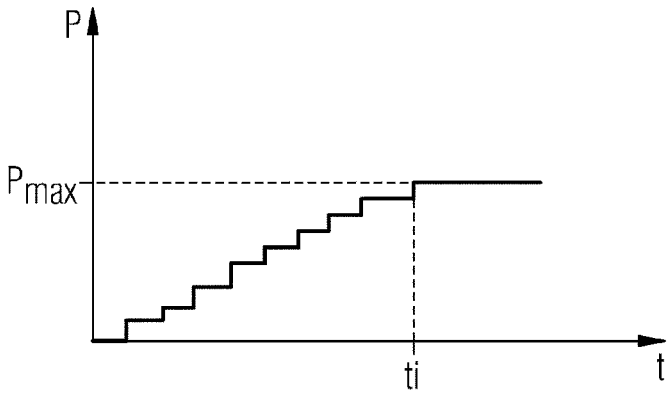
FIG. 3 shows a graph to illustrate activation of the prefeed pump during pump performance detection.

FIG. 3 shows how, after switching on the ignition and until time t=ti is reached, the performance P of the prefeed pump is gradually or progressively linearly increased up to a maximum performance Pmax.

Figure 4:
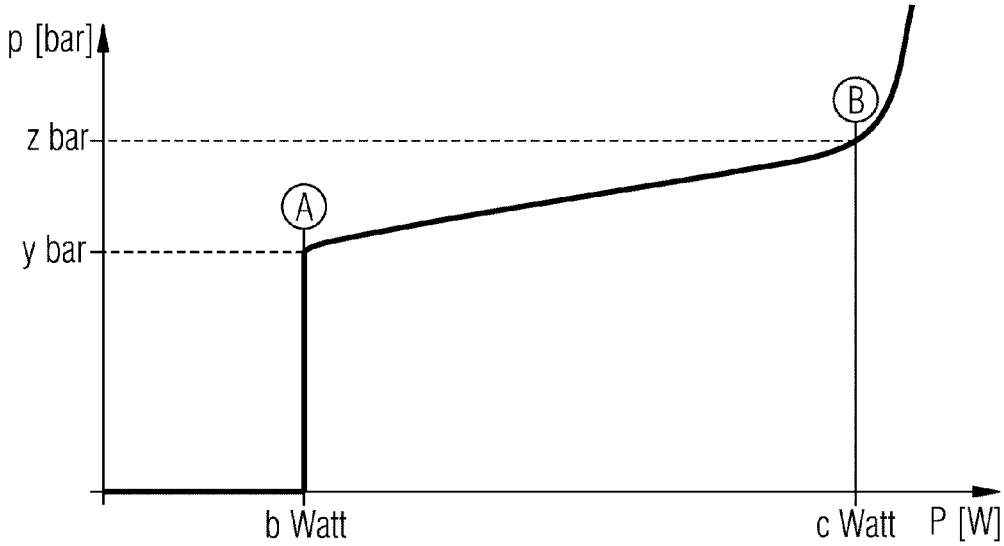
FIG. 4 shows a graph to illustrate the pressure characteristic curve as a function of the performance of the prefeed pump.

FIG. 4 shows the form of the pressure increase curve as a function of the performance P of the prefeed pump 2, the prefeed pressure p being plotted along the ordinate and the performance P of the prefeed pump being plotted along the abscissa.

It may be seen that the pressure increase curve has transition points or changes in gradient which are determined by the behavior of the individual fuel circuit components. The controller 14 can associate the individual influences of the various fuel circuit components with the respective fuel circuit components by using the respectively instantaneous pressure level. For example, in FIG. 4 the opening instant of the pressure-limiting valve 6 is located at the transition point A at which the pressure is y bar and the performance is b watts, and the instant of "leaving linearity" is located at transition point B at which the pressure is z bar and the performance is c watts. These instants or transition points are detected in the controller by evaluating the parameter pairs: actual pressure value signal/performance value, for example by way of a gradient calculation, and are stored in the memory 14*a* in the form of adaptation values. During subsequent operation of the common rail injection system these adaptation values are used to adapt series variance in the prefeed pump 2, with the offset and the gradient of the prefeed performance increase characteristic curve being adjusted.

As already stated above, the stored values may also be used to detect the loading of the fuel filter 3. The above-mentioned transition points A and B or the associated parameter values actual pressure value and performance are therefore monitored during the engine's running time. If the performance exceeds an adjustable limiting value at transition point A, a "change fuel filter" status flag is then set by the controller 14 and a warning light, for example, comes on in the vehicle's dashboard.

The above-described method assumes that the prefeed pump 2 is an electrically activatable prefeed pump.

If, in contrast to this, a fixed delivery pump is present then the above-described method may only be used to a limited extent and may only be used for filter loading detection.

Therefore in this case the ignition is firstly switched on so the electrical supply to the controller 14, the high-pressure sensor 12 and the high-pressure control actuators of the high-pressure fuel pump are activated. The prefeed pump is then switched on and the pressure value that is established is measured and stored. This stored pressure value is used to detect the fuel filter loading by recording it over the engine's running time. If the pressure falls below an adjustable limiting value the flag "change fuel filter" is then set.

What is claimed is:

1. A method for adapting a performance of a fuel prefeed pump of a motor vehicle which has a common rail injection system, an internal combustion engine, the common rail injection system including the fuel prefeed pump and a high-pressure fuel pump arranged downstream of the fuel prefeed pump and configured to deliver fuel to a common rail, the method comprising:

after the ignition is switched on and before the internal combustion engine is started, determining and storing adaptation values which are assigned to the fuel prefeed pump and describe its individual performance by:

for each of a plurality of different performance values:

communicating control signals to actuate the fuel prefeed pump according to the performance value to cause the fuel prefeed pump to deliver fuel from a fuel tank to the rail via the high-pressure fuel pump, such that the fuel pressure in the rail reaches a prefeed pressure created by the fuel prefeed pump, and measuring the fuel pressure in the rail using a pressure sensor, and determining and storing adaption values based on the measured fuel pressures corresponding to the different performance values for the fuel prefeed pump, and during normal operation of the common rail injection system after the internal combustion engine is started, determining an actuating signal for the prefeed pump using the adaptation values to supply fuel to the high-pressure fuel pump at a desired pressure.

2. The method according to claim 1, wherein the performance values for the fuel prefeed pump are gradually linearly increased up to maximum performance of the fuel prefeed pump and pairs of parameters are formed, one of these parameters being a performance value and the other parameter being the measured pressure value corresponding to this performance value.

3. The method according to claim 2, comprising storing the parameter pairs.

4. The method according to claim 2, wherein the parameter pairs are used to create a pressure characteristic curve individually assigned to the prefeed pump.

5. The method according to claim 4, wherein transitions at which changes in gradient occur are detected in the pressure characteristic curve individually assigned to the prefeed pump.

6. The method according to claim 5, wherein the adaptation values are determined from the pressure and perfoiniance values associated with the transitions.

7. The method according to claim 5, wherein the pressure and performance values associated with the transitions are stored in a memory as non-volatile information, and during a life of the common rail injection system the transitions in the pressure characteristic curve are repeatedly determined and associated pressure and performance values are stored in a memory as non-volatile information, and the loading condition of a fuel filter arranged in the motor vehicle is deteimined by using the stored pressure and performance values.

8. A motor vehicle comprising:

an internal combustion engine, a common rail injection system including a fuel prefeed pump and a high-pressure fuel pump arranged downstream of the fuel prefeed pump and configured to deliver fuel to a common rail, and a controller configured to:

after the ignition is switched on and before the internal combustion engine is started, determine and store adaptation values which are assigned to the fuel prefeed pump and describe its individual performance by:

for each of a plurality of different performance values:

communicating control signals to actuate the fuel prefeed pump according to the performance value to cause the fuel prefeed pump to deliver fuel from a fuel tank to the rail via the high-pressure fuel pump, such that the fuel pressure in the rail reaches a prefeed pressure created by the fuel prefeed pump, and measuring the fuel pressure in the rail using a pressure sensor, and determining and storing adaption values based on the measured fuel pressures corresponding to the different performance values for the fuel prefeed pump, and during normal operation of the common rail injection system after the internal combustion engine is started, determine an actuating signal using the stored adaptation values and to control the prefeed pump by means of said actuating signal to supply fuel to the high-pressure fuel pump at a desired pressure.

9. The motor vehicle according to claim 8, wherein the performance values for the fuel prefeed pump are gradually linearly increased up to maximum performance of the fuel prefeed pump and pairs of parameters are formed, one of these parameters being a performance value and the other parameter being the measured pressure value corresponding to this performance value.

10. The motor vehicle according to claim 9, wherein the parameter pairs are stored.

11. The motor vehicle according to claim 9, wherein the parameter pairs are used to create a pressure characteristic curve individually assigned to the prefeed pump.

12. The motor vehicle according to claim 11, wherein transitions at which changes in gradient occur are detected in the pressure characteristic curve individually assigned to the prefeed pump.

13. The motor vehicle according to claim 12, wherein the adaptation values are determined from the pressure and performance values associated with the transitions.

14. The motor vehicle according to claim 12, further comprising a memory storing the pressure and performance values associated with the transitions as non-volatile information, wherein during a life of the common rail injection system the transitions in the pressure characteristic curve are repeatedly determined and associated pressure and performance values are stored in the memory as non-volatile information, and the loading condition of a fuel filter arranged in the motor vehicle is determined by using the stored pressure and performance values.

15. The motor vehicle according to claim 8, further comprising a temperature sensor coupled with the controller and measuring a temperature of the fuel.

16. The motor vehicle according to claim 8, further comprising a pressure-limiting valve returning fuel into a fuel tank when the pressure of the fuel exceeds a predefined limiting value.

17. The motor vehicle according to claim 8, comprising a flushing valve and a flushing throttle arranged between the high-pressure fuel pump and and a return path to the fuel tank.

18. The motor vehicle according to claim 17, further comprising a pressure-regulating valve connected to the high-pressure fuel pump and limiting the pressure of highly pressurized fuel leaving the high-pressure fuel pump to a predefined maximum value.

* * * * *